US009451803B2

(12) United States Patent
Smith

(10) Patent No.: US 9,451,803 B2
(45) **Date of Patent: *Sep. 27, 2016**

(54) ARTICLE OF FOOTWEAR HAVING CHAMBER CAPABLE OF HOLDING VACUUM

(71) Applicant: NIKE, Inc., Beaverton, OR (US)

(72) Inventor: Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 91 days.

This patent is subject to a terminal disclaimer.

(21) Appl. No.: 14/496,904

(22) Filed: Sep. 25, 2014

(65) Prior Publication Data

US 2015/0135554 A1 May 21, 2015

Related U.S. Application Data

(63) Continuation of application No. 13/323,442, filed on Dec. 12, 2011, now Pat. No. 8,869,433.

(51) Int. Cl.

| | |
|---|---|
| ***A43B 1/00*** | (2006.01) |
| ***A43B 5/02*** | (2006.01) |
| ***A43B 7/32*** | (2006.01) |
| ***A43B 23/02*** | (2006.01) |
| ***A43C 11/00*** | (2006.01) |

(52) U.S. Cl.

CPC ..... *A43B 7/32* (2013.01); *A43B 1/0018* (2013.01); *A43B 5/02* (2013.01); *A43B 23/0235* (2013.01); *A43C 11/00* (2013.01)

(58) Field of Classification Search

CPC .... A43B 1/0018; A43B 5/02; A43B 5/0429; A43B 5/0431; A43B 5/1433; A43B 5/0435; A43B 23/0235; A43B 23/045

USPC ..... 36/88, 93, 102, 128

See application file for complete search history.

(56) References Cited

U.S. PATENT DOCUMENTS

| | | | | |
|---|---|---|---|---|
| 2,708,320 | A | 5/1955 | Hilton | |
| 2,746,173 | A | 5/1956 | Tranmal | |
| 3,811,466 | A * | 5/1974 | Ohringer | F16K 15/147 137/493 |
| 3,848,286 | A | 11/1974 | Kahmann | |
| 4,654,986 | A | 4/1987 | George | |
| 4,702,022 | A * | 10/1987 | Porcher | A43B 5/0407 36/117.7 |
| 4,724,627 | A | 2/1988 | Sisco | |
| 4,888,887 | A | 12/1989 | Solow | |
| 4,964,229 | A | 10/1990 | Laberge | |
| 5,257,470 | A | 11/1993 | Auger et al. | |
| 5,383,290 | A | 1/1995 | Grim | |
| 5,392,534 | A | 2/1995 | Grim | |
| 5,617,650 | A | 4/1997 | Grim | |

(Continued)

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear includes an upper and a sole. The article of footwear also includes an outer surface defined on the upper or the sole. Moreover, the article of footwear includes a chamber wall operably coupled to one of the upper and the sole. The chamber wall defines at least a portion of a chamber operable to hold a vacuum for at least partially conforming the footwear to the foot of the wearer. Moreover, the footwear includes a valve including a passage that extends through the chamber wall to be in selective fluid communication with the chamber. The valve is operable to provide suction to draw the vacuum within the chamber. The valve is partially defined by an outer rim, and the outer rim is flush with the outer surface or recessed inward from the outer surface toward the chamber.

20 Claims, 3 Drawing Sheets

(56) References Cited

U.S. PATENT DOCUMENTS 5,727,338 A 3/1998 George et al.
5,992,872 A * 11/1999 Proctor ..... A43B 3/0031 280/611
6,066,107 A 5/2000 Habermeyer
7,716,853 B2 5/2010 Finnegan
8,034,035 B2 * 10/2011 Weaver ..... A61M 25/0097 251/12
8,187,234 B2 * 5/2012 Weaver ..... A61M 39/24 604/247
2004/0163278 A1 8/2004 Caspers et al.

* cited by examiner

ARTICLE OF FOOTWEAR HAVING CHAMBER CAPABLE OF HOLDING VACUUM

CROSS-REFERENCE TO RELATED APPLICATION(S)

This application is a continuation of U.S. patent application Ser. No. 13/323,442, filed on Dec. 12, 2011, and published as U.S. Patent Publication No. 2013/0145656 on Jun. 13, 2013, the disclosure of which is hereby incorporated by reference.

FIELD

The present disclosure relates to an article of footwear and, more particularly, to an article of footwear having a chamber capable of holding a partial vacuum.

BACKGROUND

This section provides background information related to the present disclosure which is not necessarily prior art.

Articles of footwear typically include an upper that is worn about the foot and a sole assembly that provides traction and, in some cases, cushioned support for the wearer. It can be advantageous for the article of footwear to fit tightly to the wearer's foot and to conform in shape to that of the foot. For instance, if the footwear fits tightly, the wearer can readily push off the ground to pivot, thrust, or otherwise move the foot, and the footwear is less likely to absorb the associated forces.

Current footwear designs include various solutions ensuring tight fit. For example, shoes often include laces, buckles, straps, and other closures that can be selectively secured such that the shoe fits tightly about the foot. Also, some shoes include inflatable bladders that can be selectively inflated such that open space within the shoe can be taken up by the inflated bladder.

Although these features have functioned adequately, the footwear may not fit tightly enough for certain situations. Also, the laces, buckles, straps, bladders, etc. can undesirably increase the weight and/or bulkiness of the footwear.

SUMMARY

This section provides a general summary of the disclosure, and is not a comprehensive disclosure of its full scope or all of its features.

An article of footwear that defines an interior space that receives a foot of a wearer is disclosed. The article of footwear includes an upper operable to be worn about the foot and a sole that is connected to the upper. The article of footwear also includes an outer surface defined on one of the upper and the sole. Moreover, the article of footwear includes a chamber wall operably coupled to one of the upper and the sole. The chamber wall defines at least a portion of a chamber operable to hold a vacuum for at least partially conforming the footwear to the foot of the wearer. Moreover, the footwear includes a valve including a passage that extends through the chamber wall to be in selective fluid communication with the chamber. The valve is operable to provide suction to draw the vacuum within the chamber. The valve is partially defined by an outer rim, and the outer rim is flush with the outer surface or recessed inward from the outer surface toward the chamber.

A footwear system is also disclosed that includes a pump having a suction head and an article of footwear that defines an interior space that receives a foot of a wearer. The article of footwear includes an upper operable to be worn about the foot and a sole that is connected to the upper. The footwear further includes an outer surface defined on one of the upper and the sole. Also, the footwear includes a chamber wall operably coupled to one of the upper and the sole. The chamber wall defines at least a portion of a chamber, and the chamber wall is operable to hold a vacuum for at least partially conforming the footwear to the foot of the wearer. Additionally, the footwear includes a valve including a passage that extends through the chamber wall to be in selective fluid communication with the chamber. The valve is operable to provide suction to draw the vacuum within the chamber. The valve is partially defined by an outer rim, and the outer rim is flush with the outer surface or recessed inward from the outer surface toward the chamber. The suction head is operable to encircle the outer rim of the valve and seal to the outer surface to draw the vacuum within the chamber.

Still further, an athletic shoe defining an interior space that receives a foot of a wearer is disclosed. The shoe includes an upper operable to be worn about the foot. The upper includes a compressible layer, an outer shell with an outer surface and an opening, and a chamber wall with a lower portion and a gasket. The lower portion is disposed between and attached directly to both the compressible layer and the outer shell. The lower portion is partially exposed through the opening in the outer shell, and the gasket is disposed outside the outer shell to encircle and seal against a leg of the wearer. The chamber wall is operable to hold a vacuum. Moreover, the shoe includes a flexible sole that is connected to the upper. Additionally, the shoe includes a valve incision formed through the lower portion of the chamber wall and exposed through the opening in the outer shell. The valve incision extends through the chamber wall to be in selective fluid communication with the chamber. The valve incision is operable to provide suction to draw the vacuum within the chamber to compress the compressible layer and draw the outer shell toward the foot.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
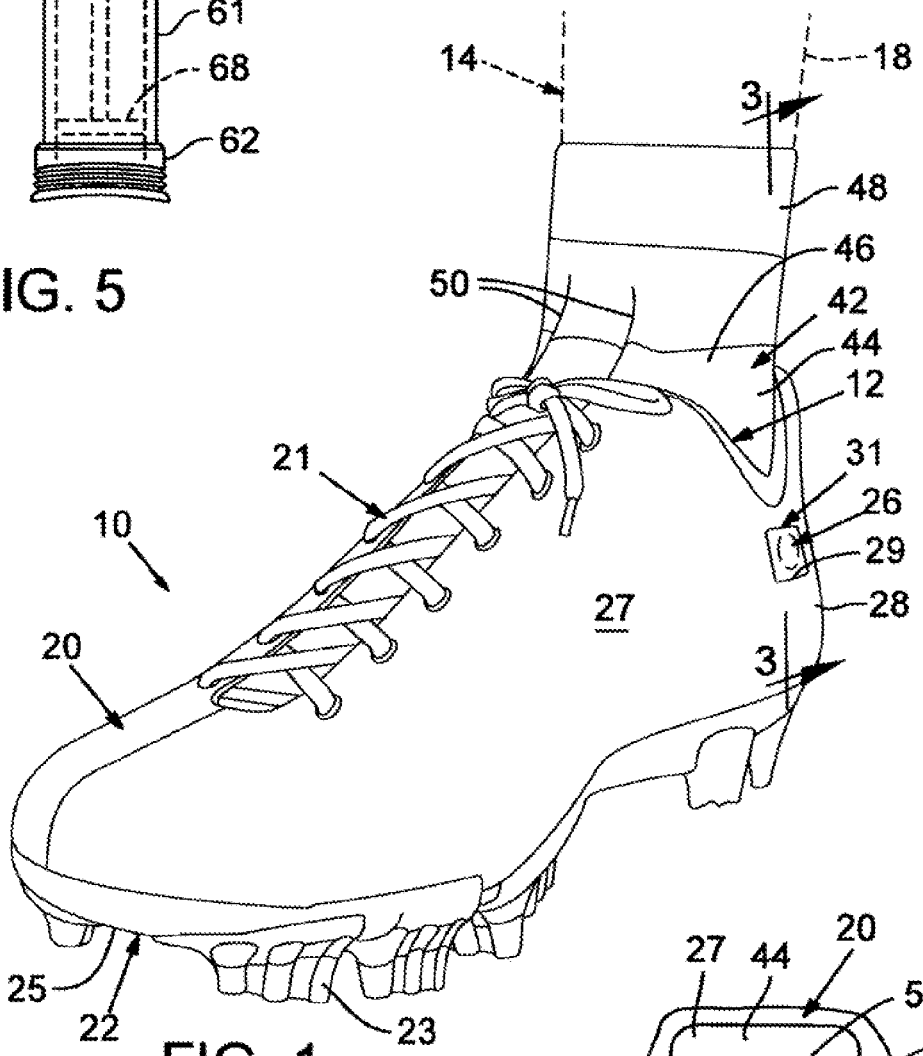
FIG. 1 is a perspective view of an article of footwear according to exemplary embodiments of the present disclosure.

Referring initially to FIG. 1, an article of footwear 10 is illustrated according to various exemplary embodiments of the present disclosure. The article of footwear 10 can define an interior space 12 that receives a lower extremity 14 (i.e., a foot 16 and lower portion of a leg 18) of a wearer.

The footwear 10 can generally include an upper 20, which is worn about the foot 16, and a sole 22, which provides traction. The upper 20 can be made out of a flexible material, such as leather, polymeric material, etc. The sole 22 can also be somewhat flexible and can be made of rubber, polyurethane, other polymeric material, a composite material, etc. The sole 22 can also include one or more spikes or cleats 23 that extend from a base surface 25 of the sole 22. Thus, in the embodiments illustrated, the footwear 10 can be an athletic shoe or boot intended for soccer or football. However, it will be appreciated that the footwear 10 can be of any suitable type and can be used for any activity or sport.

As will be discussed, the article of footwear 10 can at least partially define a substantially airtight chamber 24 (FIGS. 3 and 4) that can hold at least a partial vacuum such that the footwear 10 can fit tightly, but comfortably to the foot 16 and lower leg 18. Also, as shown in FIGS. 1, 2, 3, and 4, the footwear 10 can include a valve 26 that defines a passage 19 (FIG. 4). In the embodiments illustrated, the valve 26 is included on the upper, but the valve 26 can also be included on the sole 22. The passage 19 of the valve 26 can be selectively sealed (closed) (shown in FIG. 3) and unsealed (opened) (shown in FIG. 4). When unsealed, the passage 19 can allow air to be sucked out of the chamber 24 to draw at least a partial vacuum therein. As such, empty space within the footwear 10 can be reduced, and the footwear 10 can fit closely and substantially conform to the foot 16 and lower leg 18 to enhance running, jumping, and other activities of the wearer.

The valve 26 can be of any suitable type. More specifically, the valve 26 can be a male-type that is received within a pump 60 (FIG. 5) for operative connection thereto. The valve 26 can also be a female-type that receives the pump 60. Also, as shown in the illustrated embodiments, the valve 26 can be formed by one or more micro-incisions that sit substantially flush with an outer surface 27 of the footwear 10 or that are recessed below the outer surface 27. As such, the valve 26 is unlikely to interfere with the user's activities (e.g., kicking a ball, etc.).

Moreover, the footwear 10 can include laces 21, buckles, straps, or other closures that allow the user to selectively cinch the upper 20 to the foot 16. However, it will be appreciated that the laces 21 and other closures may not be necessary for holding the footwear 10 on the foot 16 because the vacuum within the chamber 24 can provide a sufficiently tight fit.

Furthermore, the footwear 10 can include a midsole (not specifically shown). The midsole can be of a known type, and the midsole can be disposed between the upper 20 and the sole 22 to provide cushioned support for the wearer.

Figure 3:
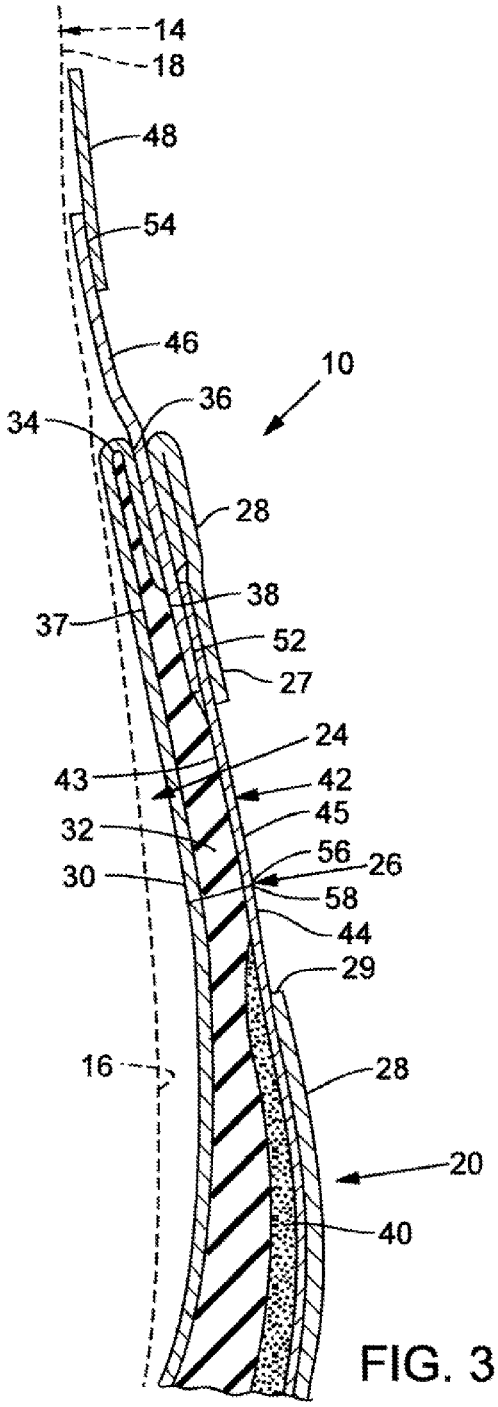
FIG. 3 is a sectional view of the article of footwear taken along the line 3-3 of FIG. 1.
Figure 4:
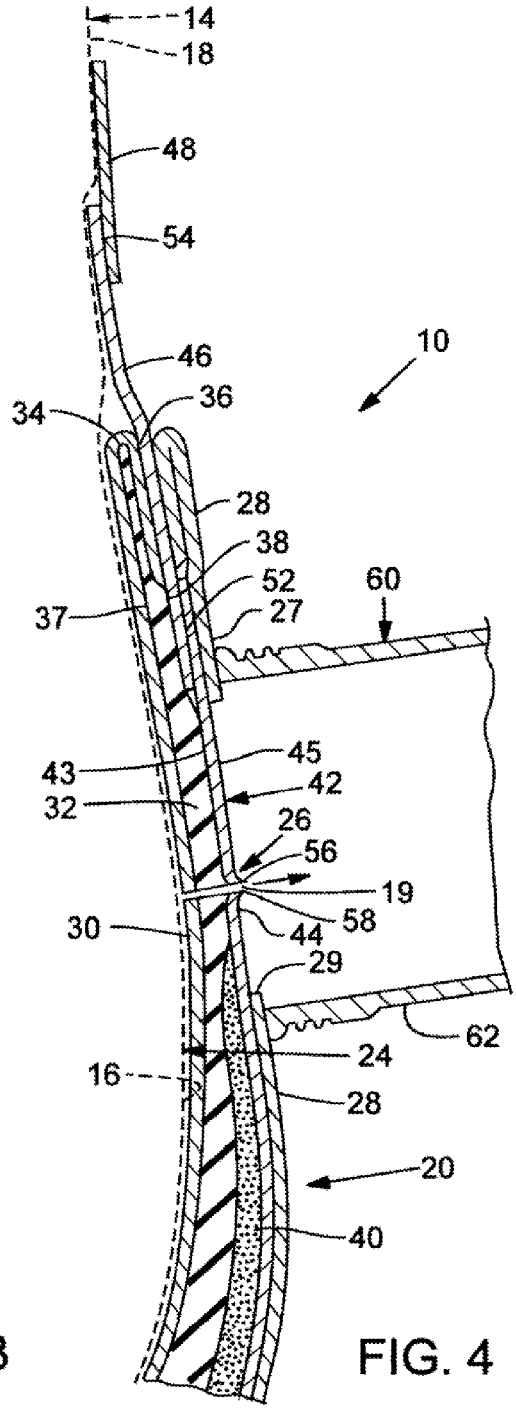
FIG. 4 is a sectional view of the article of footwear shown with a pump that is drawing a vacuum within the footwear.

Referring now to FIG. 3, the upper 20 will be described in greater detail according to exemplary embodiments. As shown, the upper 20 can include a plurality of layers, including an outer shell 28. The outer shell 28 can define the outer surface 27 of the upper 20. The outer shell 28 can extend about and wrap around the foot 16. The outer shell 28 can be made out of one or more sheets of leather, polymer, etc. The outer shell 28 can also define an opening 29. The opening 29 can be rectangular as shown in FIG. 1. The opening 29 can provide exposure for the valve 26. The opening 29 can be defined anywhere on the footwear 10; however, in the embodiments illustrated, the opening 29 is disposed on a lateral portion 31, which covers the lateral portion of the foot 16 and lower leg 18 (e.g., the outer ankle).

The upper 20 can also include an internal lining 30. The lining 30 can be made out of any suitable material (e.g., woven textile, etc.). The lining 30 can be disposed inside the outer shell 28 such that the internal lining 30 directly contacts and surrounds the foot 16.

The upper 20 can additionally include a compressible inner layer 32. The compressible inner layer 32 can be resiliently compressible and can be made out of any suitable material (e.g., foam, etc.). The inner layer 32 can include an interior surface 37 and an exterior surface 38. The compressible inner layer 32 can be layered between the internal lining 30 and the outer shell 28. Also, the inner layer 32 can be attached directly to the internal lining 30 at attachment 34. For instance, as shown in FIG. 3, the internal lining 30 can be attached (e.g., adhesively bonded) to the interior surface 37 of the inner layer 32, and an upper end 36 of the lining 30 can be folded over and attached (e.g., adhesively bonded) to an exterior surface 38 of the compressible inner layer 32.

The upper 20 can further include a heel counter 40. The heel counter 40 can be made out of leather, foam, or other material and can generally cup the heel of the foot 16 to provide additional support thereto. The heel counter 40 can be attached (e.g., adhesively bonded) to the exterior surface 38 of the compressible inner layer 32.

Moreover, the upper 20 can include a chamber wall 42. The chamber wall 42 can include a lower portion 44 made from a relatively thin sheet of material that is shaped similar to a sock that receives the foot 16. The lower portion 44 can be flexible and can be made from a polymeric material that is substantially gas impermeable. The lower portion 44 can be layered between the outer shell 28 and the compressible inner layer 32 and/or the heel counter 40. More specifically, portions of an interior surface 43 of the lower portion 44 can be attached (e.g., adhesively bonded) to the compressible inner layer 32 and other portions of the interior surface 43 can be attached (e.g., adhesively bonded) to the heel counter 40. Furthermore, an exterior surface 45 of the lower portion 44 can be attached (e.g., adhesively bonded) to the outer shell 28. Additionally, the exterior surface 45 of the lower portion 44 can be partially exposed through the opening 29 in the outer shell 28.

Still further, the chamber wall 42 can include a resiliently flexible (resiliently stretchable) portion 46. The portion 46 can be ring-shaped so as to continuously surround the lower leg 18 of the wearer. The portion 46 can be attached and substantially sealed to the lower portion 44 at a lap seam 52 or other coupling. In some embodiments, the portion 46 can be adhesively bonded to the interior surface 43 of the lower portion 44. The portion 46 can extend upward from the lower portion 46 and project out of the outer shell 28 of the upper 20. The portion 46 can also be substantially gas impermeable. The portion 46 can resiliently stretch to provide comfort for the wearer.

Moreover, as shown in FIGS. 1 and 3, the chamber wall 42 can include a gasket 48. The gasket 48 can be resiliently flexible and can be ring-shaped so as to continuously surround the lower leg 18 of the wearer. The gasket 48 can be attached and substantially sealed to the flexible portion 46 (e.g., via adhesive bonding) at a second lap seam 54. As such, the gasket 48 can extend upward from the flexible portion 46 and project away from the outer shell 28 of the upper 20 to fit around the lower leg 18. The gasket 48 can be gas impermeable and can substantially seal to the lower leg 18 to thereby contain the vacuum within the footwear 10.

The chamber wall 42 can also include one or more prepared folds 50 (gusseted folds). The prepared folds 50 can be included on the resiliently flexible portion 46 or on any other portion of the chamber wall 42. The prepared folds 50 can allow the chamber wall 42 to unfold and expand the chamber 24 or fold and constrict the chamber 24 as needed. For instance, when the wearer attempts to slip the footwear 10 over the foot 16, the folds 50 can unfold to provide sufficient room inside the footwear 10. On the contrary, when the vacuum is drawn inside the footwear 10, the chamber wall 42 can fold along the folds 50 to fit the footwear 10 more closely to the foot 16.

Thus, the chamber wall 42 can wrap around and receive the foot 16 of the wearer like a sock. As such, the chamber 24 can be defined between the foot 16 and the chamber wall 42 (i.e., the chamber wall 42 and the foot 16 can cooperate to define the chamber 24). The gasket 48 of the chamber wall 42 can substantially seal off the chamber 24 for holding a vacuum within the chamber 24.

Figure 2:
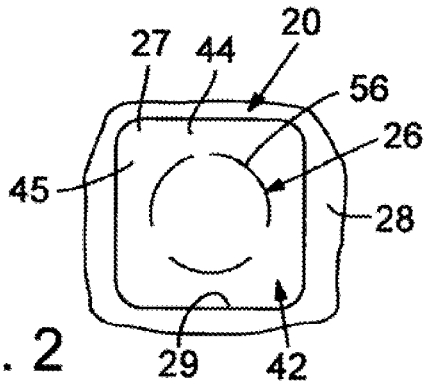
FIG. 2 is a detail view of a valve of the article of footwear of FIG. 1.

The valve 26 can be defined in the lower portion 44 of the chamber wall 42 and can be exposed through the opening 29 in the outer shell 28 as shown in FIGS. 1, 2, and 3. In the embodiments illustrated, the valve 26 can be defined by one or more incisions 56 that extend through the chamber wall 42, the compressible inner layer 32, and the lining 30. Each incision 56 can define the passage 19 into and out of the chamber 24 as shown in FIG. 3.

The incisions 56 can be micro-incisions that are formed by a laser or by other means. As such, the incisions 56 can have well defined edges and surfaces that seal together to limit leakage. More specifically, the incisions 56 can be biased toward a sealed, closed position (i.e., the incisions 56 can be self-sealing) (see FIG. 3) due to the inherent elasticity of the material of the chamber wall 42. When significant pressure is applied or when a significant amount of shear stress is applied to the exterior surface 45 of the chamber wall 42, the incisions 56 can be forced open (FIG. 4) to allow air to pass through the passage 19 into or out of the chamber 24.

In the embodiments illustrated, there are three incisions 56 defining the valve 26. The incisions 56 can be arcuate and arranged end-to-end in a generally circular pattern (FIG. 2). However, there can be any number of incisions 56 arranged in any suitable pattern.

Also, as shown in FIGS. 3 and 4, the incisions 56 each define a respective outer rim 58 (i.e., the exterior edges of the incisions 56 defined on the exterior surface 45 of the lower portion 44 of the chamber wall 42). When sealed closed, the outer rim 58 (and, thus, the entire valve 26) can be recessed below the outer surface 27 of the outer shell 28 as shown in FIG. 3. Also, in some embodiments, the outer rim 58 can be substantially flush with the outer surface 27 of the outer shell 28. Thus, the valve 26 is unlikely to obstruct movement of a ball or other object over the outer surface 27 of the footwear 10 (e.g., while playing soccer, kicking a football, etc.).

Figure 5:
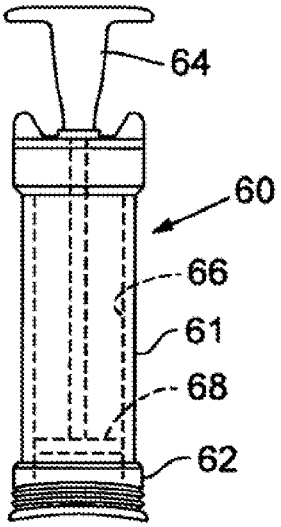
FIG. 5 is a side view of the pump of FIG. 4.

To draw a vacuum within the footwear 10, a pump 60 can be used. The pump 60 can be a handheld, portable, and manual pump 60 as shown in FIG. 5. Also, the pump 60 can be a nonportable pump. Also, the pump 60 can be electrically or otherwise automatically operated.

In the embodiments of FIG. 5, the pump 60 can include a hollow base 61 that defines a chamber 66 therein. The base 61 can include a suction head 62 at one end. The suction head 62 can be ring-shaped and can be made out of a flexible material. The suction head 62 can be ribbed to enhance flexibility. The pump 60 can also include a handle 64 that is attached to a paddle 68. The handle 64 can slide up and down relative to the base 61 to thereby move the paddle 68 within the chamber 66.

Thus, as shown in FIG. 4, the suction head 62 can encircle and surround the valve 26 and substantially seal against the outer surface 27 of the outer shell 28. Then, the handle 64 of the pump 60 can be pulled away from the base 61 to move the paddle 68 away from the suction head 62, thereby sucking air within the chamber 24 through the lining 30, through the compressible inner layer 32, and through the passages 19 of the valve 26. As a result, a vacuum can be drawn inside the chamber 24, and the outer shell 28 can be drawn generally toward the foot 16. The compressible inner layer 32 and/or other layers can also compress toward the foot 16 due to the vacuum. The handle 64 of the pump 60 can be actuated as much as necessary to closely conform the upper 20 to the foot 16. In some embodiments, drawing the vacuum can also pull the sole 22 closer to the foot 16. Thus, the footwear 10 can tightly, but comfortably, fit to the foot 16 for enhanced athletic performance.

The flexible portion 46 of the chamber wall 42 can resiliently flex during running, kicking, or other movements of the user, and the gasket 48 can substantially seal against the leg 18 to maintain the vacuum within the chamber 24 and maintain the tight fit of the footwear 10.

Then, when desired, the user can press on the valve 26, apply shear force to the valve 26 or otherwise open the incisions 56 to open the valve 26 and allow air to pass through the passages 19, through the compressible inner layer 32, and through the lining 30. Otherwise, the user can move the gasket 48 away from the leg 18 to unseal the chamber 24.

Figure 6:
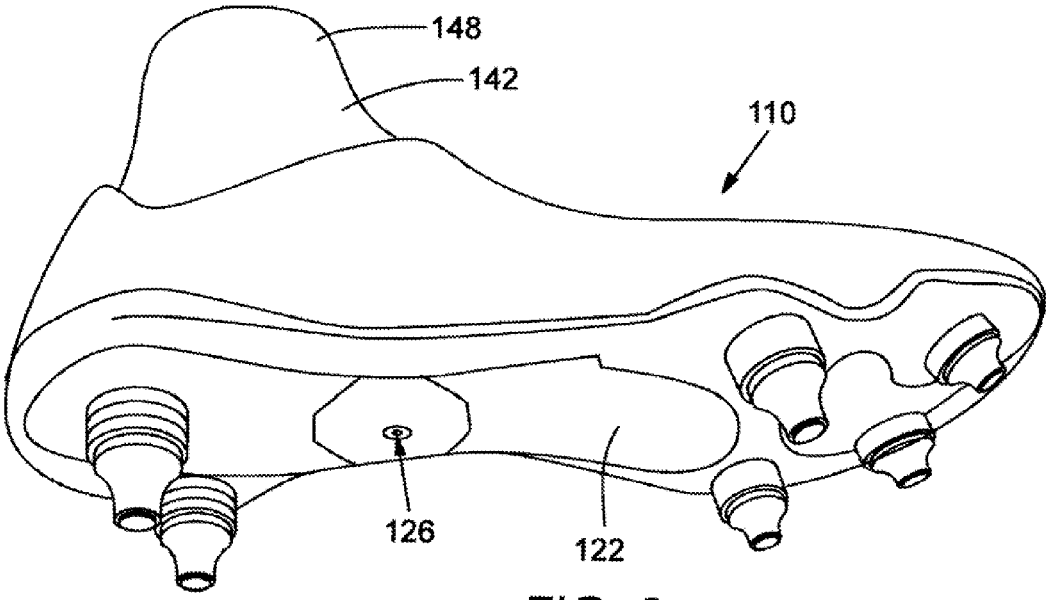
FIG. 6 is a bottom view of an article of footwear according to additional embodiments.

Referring now to FIG. 6, additional embodiments of the article of footwear 110 are illustrated. Components that correspond to those of FIGS. 1-4 are indicated with corresponding reference numbers increased by 100.

As shown, the valve 126 can be defined in the sole 122. Specifically, the valve 126 can be a female-type valve 126 operable to receive a needle or other male-type head of a pump (not shown). The valve 126 can be substantially centered on the sole 122. The valve 126 can be in fluid communication with the chamber defined by the chamber wall 142. Also, like the embodiments of FIGS. 1-4, the chamber wall 142 can include a gasket 148 for sealing the chamber and holding the vacuum.

Accordingly, the article of footwear 10, 110 and the pump 60 (i.e., the footwear system) can be very useful for providing tight fitting, but comfortable footwear 10, 110. Because the footwear 10, 110 can fit more tightly than footwear of the prior art, the footwear 10, 110 is less likely to absorb loads used for pushing off the ground during running, jumping, kicking objects, etc. Thus, the footwear 10, 110 can enhance athletic abilities and performance. Also, the footwear 10, 110 is unlikely to slip relative to the foot 16, which can reduce the chances of painful rubbing, blisters, or other injuries.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An article of footwear that defines an interior space that is configured to receive a foot of a wearer comprising:

an upper operable to be worn about the foot;

a sole that is connected to the upper;

a resiliently flexible chamber wall defining at least a portion of a chamber operable to hold a vacuum within the upper, the chamber wall including an outer surface, wherein a tangential direction is defined across the outer surface;

a compressible layer that is layered on the chamber wall inside the chamber, the compressible inner layer configured to compress between the chamber wall and the foot;

a passage that extends continuously through the chamber wall and the compressible layer from the outer surface to the chamber;

wherein the chamber wall defines a valve that regulates flow of a fluid through the passage, the valve having a plurality of inner surfaces;

wherein the valve has a closed position and an open position;

wherein the plurality of inner surfaces of the valve seal together in the closed position to substantially hold the vacuum within the chamber;

wherein, when the valve is in the open position, the plurality of inner surfaces are spaced apart in the tangential direction;

wherein the plurality of inner surfaces move in the tangential direction as the valve moves between the closed position and the open position; and wherein the valve is biased toward the closed position so as to be self-healing.

2. The article of footwear of claim 1, further comprising a lining that is disposed inside the chamber, wherein the compressible layer is layered between the lining and the chamber wall.

3. The article of footwear of claim 1, wherein the compressible layer includes a foam material.

4. The article of footwear of claim 1, wherein the passage includes an outer rim that is coincident with the outer surface; and wherein the valve is defined at least partially by the outer rim.

5. The article of footwear of claim 1, wherein the upper includes an outer shell that is layered on the chamber wall;

wherein the outer shell includes an opening;

wherein the valve is exposed within the opening.

6. The article of footwear of claim 5, wherein the outer shell includes an outer shell surface; and wherein the valve is recessed inward from the outer shell surface toward the chamber.

7. The article of footwear of claim 5, wherein the chamber wall includes a gasket;

wherein the gasket extends away from the outer shell; and wherein the gasket is operable to continuously encircle the wearer and to seal against the wearer to maintain the vacuum.

8. The article of footwear of claim 5, wherein the outer shell is flexible, and wherein the sole is a flexible sole.

9. The article of footwear of claim 5, wherein the valve is disposed on a lateral side of the upper.

10. The article of footwear of claim 1, wherein the passage is defined by a plurality of elongate incisions that extend across the outer surface and through the chamber wall; and wherein the plurality of elongate incisions are arranged end-to-end.

11. The article of footwear of claim 10, wherein the plurality of elongate incisions extend in an arc across the outer surface; and wherein the plurality of elongate incisions are arranged end-to-end in a generally annular pattern.

12. An article of footwear that defines an interior space that is configured to receive a foot of a wearer comprising:

a sole; and an upper that is connected to the sole;

a resiliently flexible chamber wall defining at least a portion of a chamber operable to hold a vacuum within the upper, the chamber wall including an outer surface, wherein a tangential direction is defined across the outer surface;

at least one inner layer that is disposed adjacent to the chamber wall inside the chamber;

a passage that extends continuously through the chamber wall and the at least one inner layer from the outer surface to the chamber;

wherein the chamber wall defines a valve that regulates flow of a fluid through the passage, the valve having a plurality of inner surfaces defined by the chamber wall;

wherein the valve has a closed position and an open position;

wherein the plurality of inner surfaces of the valve seal together in the closed position to substantially hold the vacuum within the chamber;

wherein, when the valve is in the open position, the plurality of inner surfaces are spaced apart in the tangential direction;

wherein the plurality of inner surfaces move in the tangential direction as the valve moves between the closed position and the open position; and wherein the valve is biased toward the closed position so as to be self-healing.

13. The article of footwear of claim 12, wherein the at least one inner layer includes a compressible inner layer that is layered on the chamber wall inside the chamber, the compressible inner layer configured to compress between the chamber wall and the foot;

wherein the passage extends continuously through the chamber wall and the compressible inner layer.

14. The article of footwear of claim 13, wherein the at least one inner layer includes a liner that is layered on the compressible inner layer;

wherein the compressible inner layer is layered between the liner and the chamber wall; and wherein the passage extends continuously through the chamber wall, the compressible inner layer, and the liner.

15. The article of footwear of claim 14, wherein the liner extends from an inner surface of the compressible inner layer to an outer surface of the compressible inner layer; and wherein a portion of the liner is layered directly on the chamber wall.

16. The article of footwear of claim 12, wherein the passage includes an outer rim that is coincident with the outer surface; and wherein the valve is defined at least partially by the outer rim.

17. The article of footwear of claim 12, wherein the upper includes an outer shell that is layered on the chamber wall;

wherein the outer shell includes an opening;

wherein the valve is exposed within the opening;

wherein the outer shell includes an outer shell surface; and wherein the valve is recessed inward from the outer shell surface toward the chamber.

18. The article of footwear of claim 17, wherein the chamber wall includes a gasket;

wherein the gasket extends away from the outer shell; and wherein the gasket is operable to continuously encircle the wearer and to seal against the wearer to maintain the vacuum.

19. The article of footwear of claim 17, wherein the outer shell is flexible, and wherein the sole is a flexible sole.

20. The article of footwear of claim 17, wherein the valve is disposed on a lateral side of the upper.

* * * * *